US007290844B2

(12) United States Patent
Takahashi et al.

(10) Patent No.: US 7,290,844 B2
(45) Date of Patent: Nov. 6, 2007

(54) PRINTER, PROGRAM AND METHOD FOR PRINTING, IMAGE PROCESSOR, PROGRAM AND METHOD FOR IMAGE PROCESSING AND RECORDING MEDIUM IN WHICH THE PROGRAMS ARE STORED

(75) Inventors: Toru Takahashi, Matsumoto (JP); Shinichi Arazaki, Shimosuwa (JP)

(73) Assignee: Seiko Epson Corporation (JP)

( * ) Notice: Subject to any disclaimer, the term of this patent is extended or adjusted under 35 U.S.C. 154(b) by 87 days.

(21) Appl. No.: 11/355,385

(22) Filed: Feb. 16, 2006

(65) Prior Publication Data

US 2006/0181561 A1 Aug. 17, 2006

(30) Foreign Application Priority Data

Feb. 17, 2005 (JP) ..... 2005-040116

(51) Int. Cl.
*B41J 29/38* (2006.01)

(52) U.S. Cl. ..... 347/14; 347/15

(58) Field of Classification Search ..... 347/14, 347/15

See application file for complete search history.

(56) References Cited

U.S. PATENT DOCUMENTS

| | | | | |
|---|---|---|---|---|
| 4,680,645 | A * | 7/1987 | Dispoto et al. | 358/3.02 |
| 6,283,571 | B1 | 9/2001 | Zhou et al. | |
| 6,293,643 | B1 | 9/2001 | Shimada et al. | |
| 6,328,404 | B1 | 12/2001 | Fujimori | |
| 6,604,806 | B1 * | 8/2003 | Yamada et al. | 347/15 |

FOREIGN PATENT DOCUMENTS

| | | |
|---|---|---|
| JP | 01-129667 | 5/1989 |
| JP | 01-235655 | 9/1989 |
| JP | 03-162977 | 7/1991 |
| JP | 05-057965 | 3/1993 |
| JP | 05-220977 | 8/1993 |
| JP | 11-151821 | 8/1999 |
| JP | 11-254662 | 9/1999 |
| JP | 2000-79710 | 3/2000 |
| JP | 2000-190470 | 7/2000 |
| JP | 2000-225716 | 8/2000 |

* cited by examiner

*Primary Examiner*—Thinh Nguyen
(74) *Attorney, Agent, or Firm*—Harness, Dickey & Pierce, P.L.C.

(57) ABSTRACT

A printer includes: a print head including a plurality of nozzles capable of printing dots of different sizes; a test-pattern forming section that forms test patterns each have only one dot size; a test-pattern printing section that prints the test patterns formed by the test-pattern forming section for each nozzle of the print head; an output-density reading section that optically reads the test patterns printed by the test-pattern printing section to determine the output densities of the test patterns; an input and output density-characteristic information generating section that generates input-and-output density information indicative of the relationship between the output densities read by the output-density reading section and the input densities of each test pattern formed by the test-pattern forming section; an input-density correcting section that corrects the input density of each nozzle of the print head on the basis of the input-and-output density information generated by the input and output-density-characteristic-information generating section; and a printing section that executes printing using the input densities corrected for each nozzle by the input-density correcting section.

9 Claims, 12 Drawing Sheets

300A

| DOT NO. | DOT SIZE | N-LEVEL GRAY-LEVEL NO | (DENSITY) LUMINANCE | MULTILEVEL RANGE |
|---|---|---|---|---|
| 0 | NO DOT | 1 | (0) 255 | |
| 1 | ● | 2 | (36) 219 | 223 |
| 2 | ● | 3 | (73) 182 | 191 |
| 3 | ● | 4 | (109) 146 | 159 |
| 4 | ● | 5 | (146) 109 | 128 |
| 5 | ● | 6 | (182) 73 | 96 |
| 6 | ● | 7 | (219) 36 | 64 |
| 7 | ● | 8 | (255) 0 | 32 |

FIG. 4

ORIGINAL IMAGE

N-LEVEL IMAGE

300B

| INPUT DENSITY | | 0 | 36 | 73 | 109 | 146 | 182 | 219 | 255 |
|---|---|---|---|---|---|---|---|---|---|
| OUTPUT DENSITY | NOZZLE NO.1 | 0 | 30 | 55 | 80 | 110 | 145 | 190 | 241 |
| | NOZZLE NO.2 | 0 | 26 | 63 | 97 | 131 | 160 | 198 | 251 |
| | ... | ... | ... | ... | ... | ... | ... | ... | ... |
| | ... | ... | ... | ... | ... | ... | ... | ... | ... |
| | ... | ... | ... | ... | ... | ... | ... | ... | ... |
| | NOZZLE NO.179 | 0 | 32 | 59 | 94 | 133 | 155 | 199 | 251 |
| | NOZZLE NO.180 | 0 | 34 | 61 | 98 | 130 | 169 | 200 | 254 |

300C

| INPUT DENSITY | | 0 | 36 | 73 | 109 | 146 | 182 | 219 | 255 |
|---|---|---|---|---|---|---|---|---|---|
| INPUT CORRECTION DENSITY | NOZZLE NO.1 | 0 | 43 | 89 | 129 | 168 | 202 | 235 | 266 |
| | NOZZLE NO.2 | 0 | 44 | 87 | 125 | 162 | 196 | 230 | 261 |
| | ... | ... | ... | ... | ... | ... | ... | ... | ... |
| | ... | ... | ... | ... | ... | ... | ... | ... | ... |
| | ... | ... | ... | ... | ... | ... | ... | ... | ... |
| | NOZZLE NO.179 | 0 | 44 | 88 | 128 | 166 | 200 | 234 | 265 |
| | NOZZLE NO.180 | 0 | 42 | 85 | 124 | 161 | 195 | 229 | 261 |

PRINTER, PROGRAM AND METHOD FOR PRINTING, IMAGE PROCESSOR, PROGRAM AND METHOD FOR IMAGE PROCESSING AND RECORDING MEDIUM IN WHICH THE PROGRAMS ARE STORED

RELATED APPLICATIONS

This application claims priority to Japanese Patent Application Nos. 2005-040116 filed Feb. 17, 2005 which is hereby expressly incorporated by reference herein in their entirety.

BACKGROUND

1. Technical Field

The present invention relates to printers of facsimile machines, copying machines, and OA equipment, and in particular, it relates to a what-is-called inkjet printer that ejects fine particles of multicolor liquid ink onto print paper (recording material) to draw predetermined characters and images, a program and a method for printing, an image processor and a program and a method for image processing, and a recording medium in which the programs are stored.

2. Related Art

Printers that employ an inkjet system (hereinafter, referred to as inkjet printers) generally draw characters or images onto a print medium (paper) to form a desired print by ejecting liquid-ink particles in dot form from the nozzles of a print head while moving a moving body called a carriage including a combination of an ink cartridge and the print head from side to side relative to the paper feed direction on the print paper. Since the carriage is equipped with ink cartridges of four colors (yellow, magenta, cyan, and black) and print heads for the individual colors, not only monochrome printing but also full-color printing of a combination of the four colors are facilitated (in addition to the four colors, six, seven, and eight colors including light cyan, light magenta, and so are in practical use).

With this type of inkjet printers that perform printing while moving the print head on a carriage laterally relative to the paper feed direction (across the width of print paper), the print head must be reciprocated from several tens to 100 times or more to print the whole page completely. This poses the problem of taking extremely more printing time than printers of other systems, e.g., electrophotographic laser printers such as copying machines.

In contrast, with inkjet printers of the type that has a print head with the same length as the width of print paper without a carriage, there is no need to move the print head along the width of the print paper, allowing what-is-called one-pass printing, which allows high-speed printing as with the laser printers. Also, there is no need to have a carriage for a print head and a driving system for moving the carriage. This offers the advantages that more compact and lightweight printer casing can be achieved, and more silent printers can be provided. The former inkjet printers are called "multipass printers"; the latter inkjet printers are called "line-head printers).

The print heads necessary for such inkjet printers have fine nozzles having diameters from about 10 to 70 μm arranged in series or in multistage in the printing direction at regular intervals. This may cause a so-called "droplet deflection phenomenon" that the direction of ink ejection of part of the nozzles tilts or the nozzles are displaced from an ideal position because of production error and as such, the dots formed by the nozzles deviate from targets.

As a result, poor printing that is a so-called "banding phenomenon" occurs in the part corresponding to the failed nozzle to decrease the print quality seriously. More specifically, when "the droplet deflection phenomenon" occurs, the distance between adjacent dots becomes uneven to cause "white lines (for white print paper)" in the part where the distance between adjacent dots is long, and "dark lines" in the part where the distance between adjacent dots is short.

Specifically, the banding phenomena tends to appear with the "line-head printers" that have a fixed print head (one-pass printing) and having a markedly larger number of nozzles than with the "multipass printers" (the multipass printers can make white lines inconspicuous by using the reciprocating motion of the print head).

Accordingly, to prevent the poor printing due to the "banding phenomenon", research and development of hardware aimed at improving the technique of manufacturing the print head and the design thereof is underway. However, it is still difficult to provide print heads that can prevent "the banding phenomenon" perfectly because of manufacturing cost, print quality, and technique.

Such "a banding phenomenon" is known to be generated because of not only the "droplet deflection phenomenon" but also "unevenness in density" of a print head.

Specifically speaking, known print heads express shading of each color by emitting several kinds of dots including "no dot" from individual nozzles. However, part of the nozzles may print dots smaller (or larger) than that of the size corresponding to input densities (pixel values) because of production error, causing linear "unevenness in density" to generate the banding phenomenon.

Accordingly, JP-A-1-129667, JP-A-3-162977, and JP-A-5-220977 cope with the unevenness in density by actually printing a test pattern using a print head that suffers from "unevenness in density", reading it with a scanner to form an unevenness-in-density correction table, a unit-by-unit gradation-correction table, or an average-nozzle-gradation correction table, and correcting gradations or the like on the basis of the tables.

However, with the technique of correction using the foregoing unit-by-unit gradation table (the minimum unit is a nozzle), it is difficult to scan one dot accurately in consideration of the optical characteristics of scanners, so that it is difficult to provide an accurate gradation correction table.

With the technique of correction using the unevenness-in-density correction table or the average-nozzle-gradation correction table, it is difficult to correct the density strictly. Any methods cannot ensure reduction in the unevenness in density.

SUMMARY

An advantage of some aspects of the invention is to provide a novel printer in which a banding phenomenon due to unevenness in density can be eliminated or can be made inconspicuous, and a program and a method for printing, an image processor and a program and a method for image processing, and a recording medium in which the programs are stored.

Form 1

A printer according to a first aspect of the invention includes: a print head including a plurality of nozzles capable of printing dots of different sizes; a test-pattern forming section that forms test patterns each have only one dot size; a test-pattern printing section that prints the test patterns formed by the test-pattern forming section for each nozzle of the print head; an output-density reading section that optically reads the test patterns printed by the test-pattern printing section to determine the output densities of the test patterns; an input-and-output-density-characteristic-information generating section that generates input-and-output density information indicative of the relationship between the output densities read by the output-density reading section and the input densities of each test pattern formed by the test-pattern forming section; an input-density correcting section that corrects the input density of each nozzle of the print head on the basis of the input-and-output density information generated by the input-and output density-characteristic information generating section; and a printing section that executes printing using the input densities corrected for each nozzle by the input-density correcting section.

Accordingly, input densities can be corrected in accordance with actual output densities for each nozzle, so that a banding phenomenon due to unevenness in density is eliminated or become inconspicuous, thus providing high-quality print efficiently.

The "banding phenomenon" in the embodiment indicates poor printing such as "white lines" and "dark lines" due to "unevenness in density" (hereinafter, this also applies to the forms for "printer", "printing program", "printing method", "image processor", "image processing program""image processing method", and "recording medium in which the programs are recorded", and the "description of exemplary embodiments").

The "unevenness in density" indicates a phenomenon in which dots of the size corresponding to an input density (pixel value) are not formed as with the other nozzles adjacent to part of the nozzles, e.g., a portion that should be even in density seems to be partially uneven in density. When the dot size is smaller than the original one, the surface of print paper is exposed correspondingly, so that white lines appear on that portion (when the print paper is white); when the dot size is larger than the original one, the surface of the print paper is covered by dots correspondingly, so that dark lines appear on that portion (hereinafter, this also applies to the forms for "printer", "printing program", "printing method", "image processor", "image-processing program" the form for "image processing method", and "recording medium in which the programs are recorded", and the "description of exemplary embodiments").

Form 2

In this case, it is preferable that the test-pattern printing section print the test patterns formed by the test-pattern forming section for each nozzle using one of the nozzles of the print head.

This allows the input densities of each nozzle of the print head to be corrected, thereby preventing a banding phenomenon caused by unevenness in density to provide high-quality print efficiently.

Form 3

In this case, it is preferable that the test-pattern printing section print the test patterns formed by the test-pattern forming section for the series of multiple nozzles of the print head using all of the nozzles collectively.

Accordingly, for multiple nozzles as in a line-head print head, a series of multiple nozzles can be collectively processed, so that processes after the test-pattern printing process can be performed efficiently.

Form 4

In this case, it is preferable that the test patterns printed by the test-pattern printing section be formed of dots of a specified size printed continuously lengthwise and breadthwise in a unit area on a printing medium, and that the output-density reading section read only the region of each test pattern except the boundary with the printing medium.

Thus, the general optical characteristics of scanners can be eliminated as much as possible, thereby allowing the densities of the test patterns to be read accurately.

More specifically, scanners having general optical characteristics, which can be applied as the output-density reading section of this form, cannot read correct values for portions with significant unevenness in luminance (density). However, if test patterns are formed of dots of a specified size printed continuously lengthwise and breadthwise in a unit area, as in the embodiment, and only the region in the unit area except the boundary with the printing medium, accurate densities can be read even with moderately priced low-resolution scanners.

Form 5

In this case, it is preferable that the input-and-output-density-characteristic-information generating section generate an approximate curve indicative of the relationship between the input densities and the output densities in the input-and-output density information to calculate intermediate output densities corresponding to the intermediate input densities between the dots from the approximate curve; and that the input-density correcting section correct the intermediate input densities between the dots according to the intermediate input densities between the dots calculated by the input-and-output-density-information generating section.

Therefore, even intermediate input densities between dots can be corrected accurately in accordance with the intermediate input densities, which will be specifically described later.

Form 6

In this case, it is preferable that the input-and output density-information generating section create a lookup table indicative of the relationship between the input densities and the output densities in the input-and-output density information, and calculates intermediate output densities corresponding to the intermediate input densities between the dots from the lookup table; and that the input-density correcting section correct the intermediate input densities between the dots according to the intermediate input densities between the dots calculated by the input and output density-information generating section.

More specifically, although the printer of Form 5 first generates an approximate curve, and then calculates intermediate output densities from the approximate curve, the approximate curve is unnecessary when all the densities of 8-bit/256-level grayscale the same as the original grayscale are measured.

Accordingly, in this case, even intermediate input densities between dots can be corrected accurately in accordance with the intermediate input densities by forming a lookup table listing input densities and output densities in one-to-one correspondence and calculating intermediate output densities between the dots corresponding to the intermediate input densities between the dots.

The same advantages can be offered when an approximate curve is formed from the result of 8-level gradation printing, and all the correction densities including intermediate output densities are calculated from the approximate curve, and a table listing input densities and output densities in one-to-one-correspondence is used as the lookup table, the same advantages as those of the above-described form can be provided.

Form 7

A print program according to a second aspect of the invention is a program for a computer to implement: a test-pattern forming section that forms test patterns each have only one dot size for each of the different dot sizes of a print head including a plurality of nozzles capable of printing dots of different sizes; a test-pattern printing section that prints the test patterns formed by the test-pattern forming section for each nozzle of the print head; an output-density reading section that optically reads the test patterns printed by the test-pattern printing section to determine the output densities of the test patterns; an input-and-output-density-characteristic-information generating section that generates input-and-output density information indicative of the relationship between the output densities read by the output-density reading section and the input densities of each test pattern formed by the test-pattern forming section; an input-density correcting section that corrects the input density of each nozzle of the print head on the basis of the input-and-output density information generated by the input-and-output-density-characteristic information generating section; and a printing section that executes printing using the input densities corrected for each nozzle by the input-density correcting section.

This eliminates unevenness in density or makes it inconspicuous, providing high-quality print efficiently, as in Form 1.

Most of printers on the market such as inkjet printers include a computer system made up of a central processing unit (CPU), storage units (RAM and ROM), and an input and output unit, with which the foregoing sections can be implemented via software. This allows the foregoing sections to be implemented economically and easily as compared with the case using dedicated hardware, and facilitates update of the version through alteration or improvement of the functions by rewriting part of the program.

Form 8

In this case, it is preferable that the test-pattern printing section print the test patterns formed by the test-pattern forming section for each nozzle using one of the nozzles of the print head.

This allows the input density of each nozzle of the print head to be corrected, preventing a banding phenomenon caused by unevenness in density to provide high-quality print effectively, as in Form 2.

The foregoing sections can be implemented using a computer system installed in most of printers on the market via software, as in Form 7. This allows the foregoing sections to be implemented economically and easily as compared with the case using dedicated hardware, and facilitates update of the version through alteration or improvement of the functions by rewriting part of the program.

Form 9

In this case, it is preferable that the test-pattern printing section print the test patterns formed by the test-pattern forming section for the series of multiple nozzles of the print head using all of the nozzles collectively.

Accordingly, a series of multiple nozzles can be collectively processed, so that processes after the test-pattern printing process can be performed efficiently, as in Form 3.

Also, the foregoing sections can be implemented using a computer system installed in most of printers on the market via software, as in Form 7. This allows the foregoing sections to be implemented economically and easily as compared with the case using dedicated hardware, and facilitates update of the version through alteration or improvement of the functions by rewriting part of the program.

Form 10

In this case, it is preferable that the test patterns printed by the test-pattern printing section be formed of dots of a specified size printed continuously lengthwise and breadthwise in a unit area on a printing medium, and that the output-density reading section read only the region of each test pattern except the boundary with the printing medium.

Thus, the general optical characteristics of scanners can be eliminated as much as possible, thereby allowing the densities of the test patterns to be read accurately, as in Form 4.

The foregoing sections can be implemented using a computer system installed in most of printers on the market via software, as in Form 7. This allows the foregoing sections to be implemented economically and easily as compared with the case using dedicated hardware, and facilitates update of the version through alteration or improvement of the functions by rewriting part of the program.

Form 11

In this case, it is preferable that the input-and-output-density-characteristic-information generating section generate an approximate curve indicative of the relationship between the input densities and the output densities in the input-and-output density information to calculate intermediate output densities corresponding to the intermediate input densities between the dots from the approximate curve; and that the input-density correcting section correct the intermediate input densities between the dots according to the intermediate input densities between the dots calculated by the input-and-output-density-information generating section.

Therefore, even intermediate input densities between dots can be corrected accurately in accordance with the intermediate input densities, as in Form 5.

The foregoing sections can be implemented using a computer system installed in most of printers on the market via software, as in Form 7. This allows the foregoing sections to be implemented economically and easily as compared with the case using dedicated hardware, and facilitates update of the version through alteration or improvement of the functions by rewriting part of the program.

Form 12

In this case, it is preferable that the input-and-output-density-information generating section create a lookup table indicative of the relationship between the input densities and the output densities in the input-and-output density information, and calculates intermediate output densities corresponding to the intermediate input densities between the dots from the lookup table; and that the input-density correcting section correct the intermediate input densities between the dots according to the intermediate input densities between the dots calculated by the input-and-output-density-information generating section.

Accordingly, intermediate input densities between dots can be corrected accurately without drawing the approximate curve, as in Form 6.

The foregoing sections can be implemented using a computer system installed in most of printers on the market via software, as in Form 7. This allows the foregoing sections to be implemented economically and easily as compared with the case using dedicated hardware, and facilitates update of the version through alteration or improvement of the functions by rewriting part of the program.

Form 13

A recording medium according to a third aspect of the invention stores the print program described in Forms 7 to 12.

Thus, the printing program described in Forms 7 to 12 can be provided for users or demanders easily and reliably via a computer-readable storage medium such as CD-ROMs, DVD-ROMs, FDs, or semiconductor chips.

Form 14

A printing method according to a fourth aspect of the invention includes: forming test patterns each have only one dot size for each of the different dot sizes of a print head including a plurality of nozzles capable of printing dots of different sizes; printing the test patterns formed in the test-pattern forming step for each nozzle of the print head; optically reading the test patterns printed in the test-pattern printing step to determine the output densities of the test patterns; generating input-and-output density information indicative of the relationship between the output densities read in the output-density reading step and the input densities of each test pattern formed by the test-pattern forming section; correcting the input density of each nozzle of the print head on the basis of the input-and-output density information generated in the input-and-output-density characteristic information generating step; and executing printing using the input densities corrected for each nozzle in the input-density correcting step.

Accordingly, unevenness in density is eliminated or become inconspicuous, thus providing high-quality print efficiently, as in Form 1.

Form 15

In this case, it is preferable that, in the test-pattern printing step, the test patterns formed by the test-pattern forming section is printed for each nozzle using one of the nozzles of the print head.

This allows the input density of each nozzle of the print head to be corrected, preventing a banding phenomenon caused by unevenness in density to provide high-quality print effectively, as in Form 2.

Form 16

In this case, it is preferable that, in the test-pattern printing step, the test patterns formed by the test-pattern forming section is printed for the series of multiple nozzles of the print head using all of the nozzles collectively.

Accordingly, a series of multiple nozzles can be collectively processed, so that processes after the test-pattern printing process can be performed efficiently, as in Form 3.

Form 17

In this case, it is preferable that the test patterns printed by the test-pattern printing section be formed of dots of a specified size printed continuously lengthwise and breadthwise in a unit area on a printing medium, and that the output-density reading section read only the region of each test pattern except the boundary with the printing medium.

Thus, the general optical characteristics of scanners can be eliminated as much as possible, thereby allowing the densities of the test patterns to be read accurately as in Form 4.

Form 18

In this case, it is preferable that, in the input and output-density-characteristic-information generating step, an approximate curve indicative of the relationship between the input densities and the output densities in the input-and-output density information be formed to calculate intermediate output densities corresponding to the intermediate input densities between the dots from the approximate curve; and in the input-density correcting step, the intermediate input densities between the dots be corrected according to the intermediate input densities between the dots calculated by the input-and-output-density-information generating section.

Therefore, even intermediate input densities between dots can be corrected accurately in accordance with the intermediate input densities as in Form 5.

Form 19

In this case, it is preferable that, in the input and output-density-information generating step, a lookup table indicative of the relationship between the input densities and the output densities in the input-and-output density information be formed to calculate intermediate output densities corresponding to the intermediate input densities between the dots from the lookup table; and in the input-density correcting step, the intermediate input densities between the dots be corrected according to the intermediate input densities between the dots calculated by the input and output density-information generating section.

Accordingly, intermediate input densities between dots can be corrected accurately without drawing the approximate curve, as in Form 6.

Form 20

An image processor according to a fifth aspect of the invention includes: a test-pattern forming section that forms test patterns each have only one dot size for each of the different dot sizes of a print head including a plurality of nozzles capable of printing dots of different sizes; a test-pattern printing section that prints the test patterns formed by the test-pattern forming section for each nozzle of the print head; an output-density reading section that optically reads the test patterns printed by the test-pattern printing section to determine the output densities of the test patterns; an input-and-output-density-characteristic-information generating section that generates input-and-output density information indicative of the relationship between the output densities read by the output-density reading section and the input densities of each test pattern formed by the test-pattern forming section; and an input-density correcting section that corrects the input density of each nozzle of the print head on the basis of the input-and-output density information generated by the input and output-density-characteristic-information generating section.

This eliminates unevenness in density or makes it inconspicuous at printing, providing high-quality print data efficiently.

The foregoing sections can be implemented using a computer system installed in most of printers on the market via software. The foregoing sections can be implemented using a general-purpose computer system via software. This allows the foregoing sections to be implemented economically and easily as compared with the case using dedicated hardware, and facilitates update of the version through alteration or improvement of the functions by rewriting part of the program.

Form 21

In this case, it is preferable that the test-pattern printing section print the test patterns formed by the test-pattern forming section for each nozzle using one of the nozzles of the print head.

This allows the input density of each nozzle of the print head to be corrected, preventing a banding phenomenon caused by unevenness in density to provide high-quality print data effectively.

Form 22

In this case, it is preferable that the test-pattern printing section print the test patterns formed by the test-pattern forming section for the series of multiple nozzles of the print head using all of the nozzles collectively.

Accordingly, a series of multiple nozzles can be collectively processed, so that processes after the test-pattern printing process can be performed efficiently.

Form 23

In this case, it is preferable that the test patterns printed by the test-pattern printing section be formed of dots of a specified size printed continuously lengthwise and breadthwise in a unit area on a printing medium, and that the output-density reading section read only the region of each test pattern except the boundary with the printing medium.

Thus, the general optical characteristics of scanners can be eliminated as much as possible, thereby allowing the densities of the test patterns to be read accurately.

Form 24

In this case, it is preferable that the input-and output-density-characteristic-information generating section generate an approximate curve indicative of the relationship between the input densities and the output densities in the input-and-output density information to calculate intermediate output densities corresponding to the intermediate input densities between the dots from the approximate curve; and that the input-density correcting section correct the intermediate input densities between the dots according to the intermediate input densities between the dots calculated by the input-and-output-density-information generating section.

Therefore, even intermediate input densities between dots can be corrected accurately in accordance with the intermediate input densities.

Form 25

In this case, it is preferable that the input-and-output-density-information generating section create a lookup table indicative of the relationship between the input densities and the output densities in the input-and-output density information, and calculates intermediate output densities corresponding to the intermediate input densities between the dots from the lookup table; and that the input-density correcting section correct the intermediate input densities between the dots according to the intermediate input densities between the dots calculated by the input and output density-information generating section.

Accordingly, intermediate input densities between dots can be corrected accurately without drawing the approximate curve.

Form 26

An image-processing program according to a sixth aspect of the invention allows a computer to implement: a test-pattern forming section that forms test patterns each have only one dot size for each of the different dot sizes of a print head including a plurality of nozzles capable of printing dots of different sizes; a test-pattern printing section that prints the test patterns formed by the test-pattern forming section for each nozzle of the print head; an output-density reading section that optically reads the test patterns printed by the test-pattern printing section to determine the output densities of the test patterns; an input and output density-characteristic-information generating section that generates input-and-output density information indicative of the relationship between the output densities read by the output-density reading section and the input densities of each test pattern formed by the test-pattern forming section; and an input-density correcting section that corrects the input density of each nozzle of the print head on the basis of the input-and-output density information generated by the input and output-density-characteristic-information generating section.

This eliminates unevenness in density or makes it inconspicuous at printing, providing high-quality print data efficiently, as in Form 20.

The foregoing sections can be implemented using a computer system installed in most of printers on the market via software. The foregoing sections can be implemented using a general-purpose computer system via software. This allows the foregoing sections to be implemented economically and easily as compared with the case using dedicated hardware, and facilitates update of the version through alteration or improvement of the functions by rewriting part of the program.

Form 27

In this case, it is preferable that the test-pattern printing section print the test patterns formed by the test-pattern forming section for each nozzle using one of the nozzles of the print head.

This allows the input density of each nozzle of the print head to be corrected, preventing a banding phenomenon caused by unevenness in density to provide high-quality print data effectively, as in Form 21.

The foregoing sections can be implemented using a general-purpose computer system via software, as in Form 26. This allows the foregoing sections to be implemented economically and easily as compared with the case using dedicated hardware, and facilitates update of the version through alteration or improvement of the functions by rewriting part of the program.

Form 28

In this case, it is preferable that the test-pattern printing section print the test patterns formed by the test-pattern forming section for the series of multiple nozzles of the print head using all of the nozzles collectively.

Accordingly, a series of multiple nozzles can be collectively processed, so that processes after the test-pattern printing process can be performed efficiently, as in Form 22.

The foregoing sections can be implemented using a computer system installed in most of printers on the market via software. The foregoing sections can be implemented using a general-purpose computer system via software, as in Form 26. This allows the foregoing sections to be implemented economically and easily as compared with the case using dedicated hardware, and facilitates update of the version through alteration or improvement of the functions by rewriting part of the program.

Form 29

In this case, it is preferable that the test patterns printed by the test-pattern printing section be formed of dots of a specified size printed continuously lengthwise and breadthwise in a unit area on a printing medium; and that the output-density reading section read only the region of each test pattern except the boundary with the printing medium.

Accordingly, a series of multiple nozzles can be collectively processed, so that processes after the test-pattern printing process can be performed efficiently, as in Form 22.

The foregoing sections can be implemented using a computer system installed in most of printers on the market via software. The foregoing sections can be implemented using a general-purpose computer system via software, as in Form 26. This allows the foregoing sections to be implemented economically and easily as compared with the case using dedicated hardware, and facilitates update of the version through alteration or improvement of the functions by rewriting part of the program.

Form 30

In this case, it is preferable that the input-and output-density-characteristic-information generating section generate an approximate curve indicative of the relationship between the input densities and the output densities in the input-and-output density information to calculate intermediate output densities corresponding to the intermediate input densities between the dots from the approximate curve; and that the input-density correcting section correct the intermediate input densities between the dots according to the intermediate input densities between the dots calculated by the input-and-output-density-information generating section.

Therefore, even intermediate input densities between dots can be corrected accurately in accordance with the intermediate input densities, as in Form 24.

The foregoing sections can be implemented using a computer system installed in most of printers on the market via software. The foregoing sections can be implemented using a general-purpose computer system via software, as in Form 26. This allows the foregoing sections to be implemented economically and easily as compared with the case using dedicated hardware, and facilitates update of the version through alteration or improvement of the functions by rewriting part of the program.

Form 31

In this case, it is preferable that the input-and output-density-information generating section create a lookup table indicative of the relationship between the input densities and the output densities in the input-and-output density information, and calculates intermediate output, densities corresponding to the intermediate input densities between the dots from the lookup table; and that the input-density correcting section correct the intermediate input densities between the dots according to the intermediate input densities between the dots calculated by the input and output density-information generating section.

Accordingly, intermediate input densities between dots can be corrected accurately without drawing the approximate curve, as in Form 25.

The foregoing sections can be implemented using a general-purpose computer system via software, as in Form 26. This allows the foregoing sections to be implemented economically and easily as compared with the case using dedicated hardware, and facilitates update of the version through alteration or improvement of the functions by rewriting part of the program.

Form 32

A computer-readable recording medium according to a seventh aspect of the invention stores the image-processing program in one of Forms 26 to 31.

Thus, the image processing program according to claim 22 can be provided for users or demanders easily and reliably via a computer-readable storage medium such as CD-ROMs, DVD-ROMs, FDs, or semiconductors.

Form 33

An image processing method according to an eighth aspect of the invention includes: forming test patterns each have only one dot size for each of the different dot sizes of a print head including a plurality of nozzles capable of printing dots of different sizes; printing the test patterns formed in the test-pattern forming step for each nozzle of the print head; optically reading the test patterns printed in the test-pattern printing step to determine the output densities of the test patterns; generating input-and-output density information indicative of the relationship between the output densities read in the output-density reading step and the input densities of each test pattern formed by the test-pattern forming section; and correcting the input density of each nozzle of the print head on the basis of the input-and-output density information generated in the input-and-output density characteristic-information generating step.

This eliminates unevenness in density or makes it inconspicuous at printing, providing high-quality print data efficiently at printing, as in Form 20.

Form 34

In this case, it is preferable that, in the test-pattern printing step, the test patterns formed in the test-pattern forming step are printed for each nozzle using one of the nozzles of the print head.

This allows the input density of each nozzle of the print head to be corrected, preventing a banding phenomenon caused by unevenness in density to provide high-quality print data effectively, as in Form 21.

Form 35

In this case, it is preferable that, in the test-pattern printing step, the test patterns formed in the test-pattern forming step be printed for the series of multiple nozzles of the print head using all of the nozzles collectively.

Accordingly, a series of multiple nozzles can be collectively processed, so that processes after the test-pattern printing process can be performed efficiently, as in Form 22.

Form 36

In this case, it is preferable that the test patterns printed by in test-pattern printing step be formed of dots of a specified size printed continuously lengthwise and breadthwise in a unit area on a printing medium; and that in the output-density reading step, only the region of each test pattern except the boundary with the printing medium be read.

Thus, the general optical characteristics of scanners can be eliminated as much as possible, thereby allowing the densities of the test patterns to be read accurately, as in Form 23.

Form 37

In this case, it is preferable that in the input-and output-density-characteristic-information generating step, an approximate curve indicative of the relationship between the input densities and the output densities in the input-and-output density information to calculate intermediate output densities corresponding to the intermediate input densities between the dots from the approximate curve; and that the input-density correcting section corrects the intermediate input densities between the dots according to the intermediate input densities between the dots calculated in the input-and-output-density-information generating step.

Therefore, even intermediate input densities between dots can be corrected accurately in accordance with the intermediate output densities as in Form 24.

Form 38

In this case, it is preferable that, in the input-and-output-density-information generating step, a lookup table indicative of the relationship between the input densities and the output densities in the input-and-output density information is created, and intermediate output densities corresponding to the intermediate input densities between the dots are calculated from the lookup table; and in the input-density correcting step, the intermediate input densities between the dots are corrected according to the intermediate input densities between the dots calculated in the input-and-output-density-information generating step.

Accordingly, intermediate input densities between dots can be corrected accurately without drawing the approximate curve as in Form 25.

BRIEF DESCRIPTION OF THE DRAWINGS

The invention will be described with reference to the accompanying drawings, wherein like numbers reference like elements.

FIG. 4 is a dot-gradation conversion table showing the relationship between pixel values and N levels, and between the N levels and dot sizes to be referred to for conversion to N-level data.

DESCRIPTION OF EXEMPLARY EMBODIMENTS

Exemplary embodiments of the invention will be described in detail with reference to the drawings. FIGS. 1 to 18 show a printer 100, a program and a method for printing, an image processor, a program and a method for image processing, and a computer-readable recording medium according to embodiments of the invention.

Figure 1:
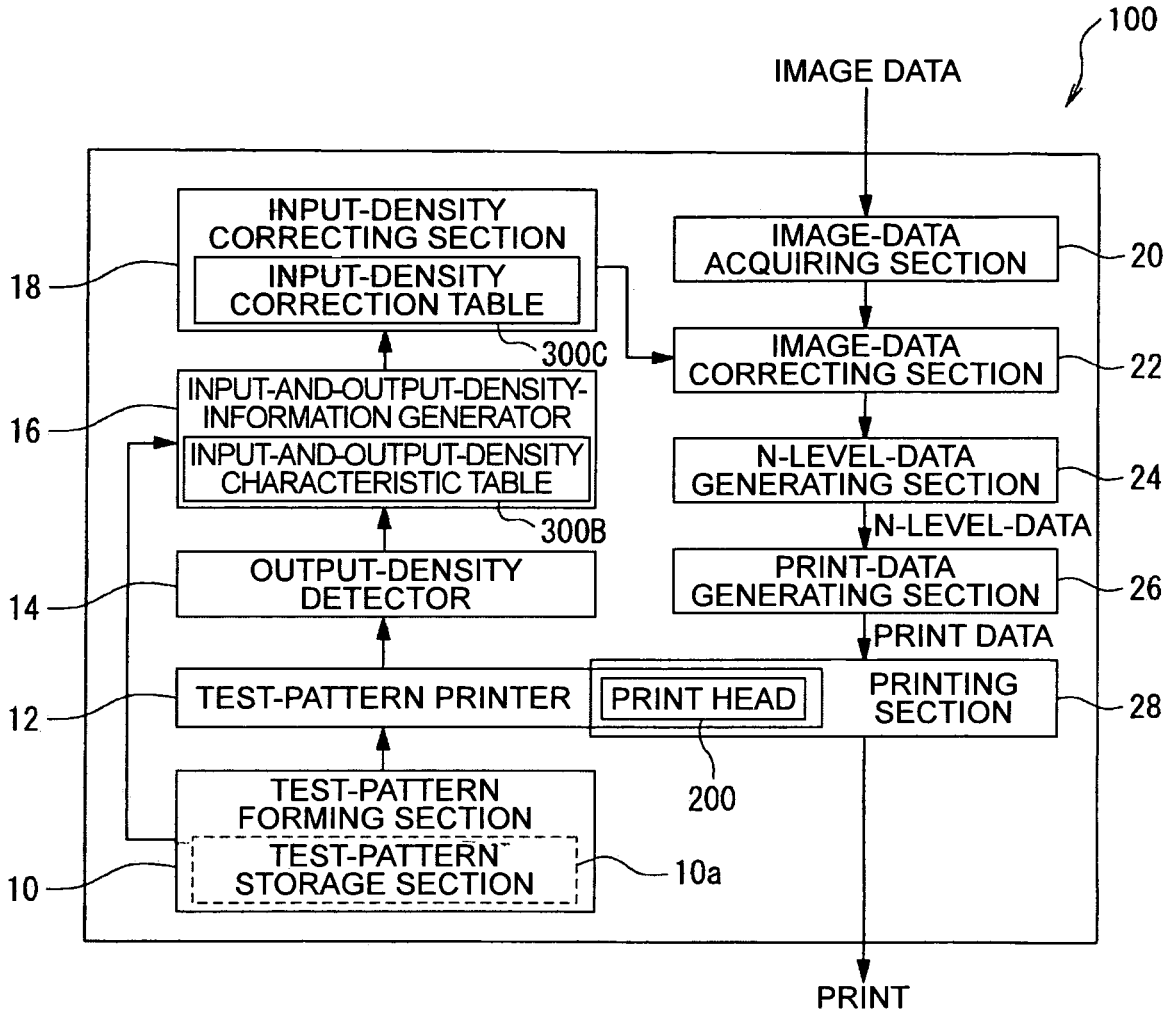
FIG. 1 is a functional block diagram of a printer according to an embodiment of the invention.

FIG. 1 is a functional block diagram of the printer 100 according to an embodiment of the invention.

As shown in the drawing, the printer 100 principally includes a print head 200 having a plurality of nozzles; a test-pattern forming section 10 that generates a test pattern made up of only dots of a specified size; a test-pattern printer 12 that prints the test pattern generated by the test-pattern forming section 10 using the print head 200; an output-density detector 14 that optically reads the test pattern printed by the test-pattern printer 12 to determine its output density; an input-and-output-density-information generator 16 that generates input- and output-density information indicative of the relationship between the output density detected by the output-density detector 14 and the input density of test patterns generated by the test-pattern forming section 10; an input-density correcting section 18 that corrects the input density of the image data on the basis of the input- and output-density information generated by the input and output-density-information generator 16; an image-data acquiring section 20 that acquires multilevel image data for printing; an image-data correcting section 22 that corrects the multilevel image data acquired by the image-data acquiring, section 20 on the basis of the input density corrected by the input-density correcting section 18; an N-level-data generating section 24 that converts the multilevel image data corrected by the image-data correcting section 22 to N-level data ($N \geqq 2$); a print-data generating section 26 that generates print data by setting dot sizes corresponding to the pixel values of the N-value image data generated by the N-level-data generating section 24; and an inkjet printing section 28 that executes printing on the basis of the print data generated by the print-data generating section 26.

The print head 200 applied to the invention will first be described.

Figure 3:
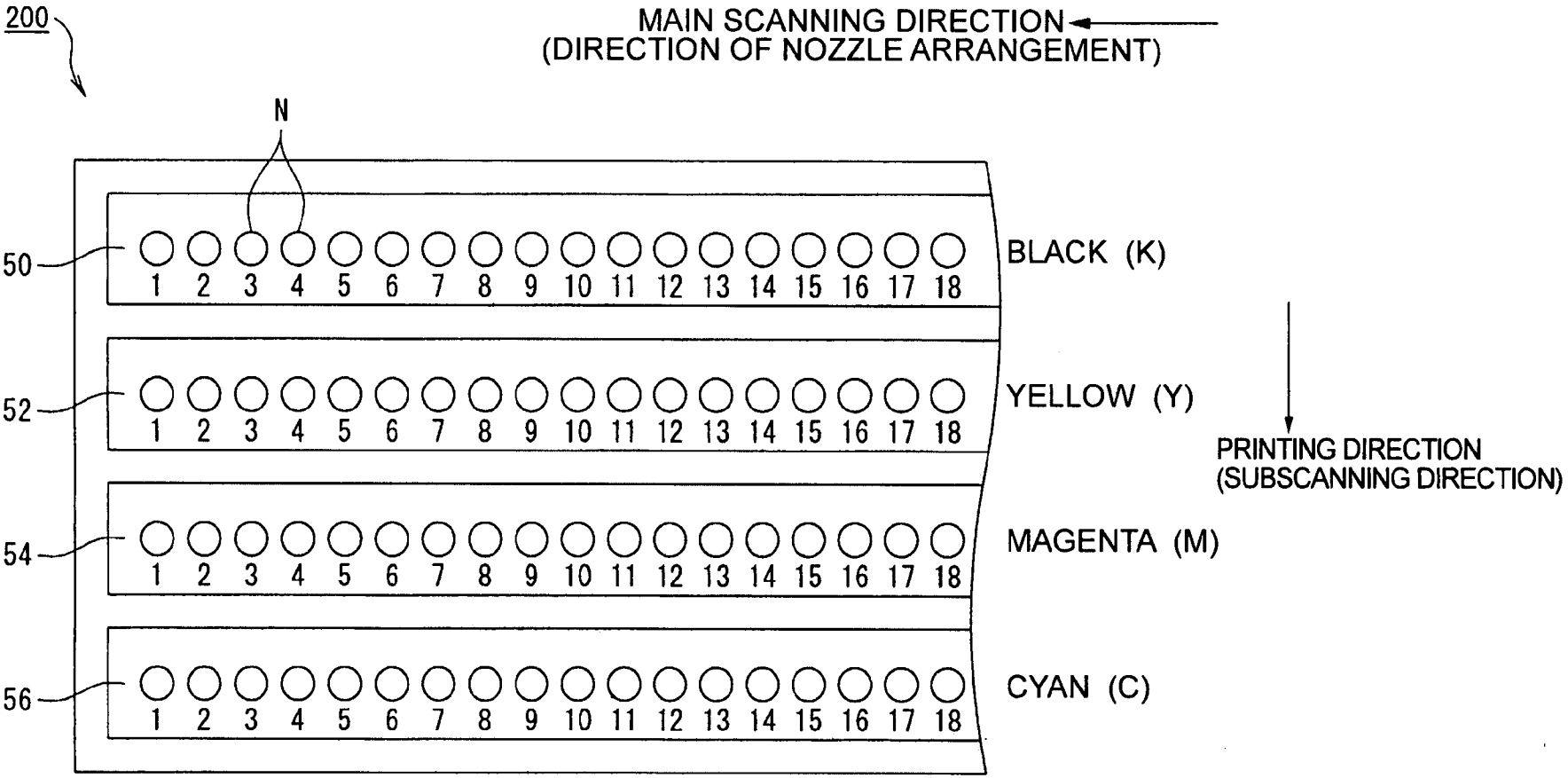
FIG. 3 is a partial enlarged bottom view of the structure of a print head.

FIG. 3 is a partially enlarged bottom view of the structure of the print head 200.

As shown in FIG. 3, the print head 200 is long along the width of print paper for use in a what-is-called line-head printer. The print head 200 includes: a black nozzle module 50 in which a plurality of nozzles N (18 nozzles in FIG. 3) that eject only a black (K) ink are arranged linearly in the main scanning direction; a yellow nozzle module 52 in which a plurality of nozzles N that eject only a yellow (Y) ink are arranged linearly in the main scanning direction; a magenta nozzle module 54 in which a plurality of nozzles N that eject only a magenta (M) ink are arranged linearly in the main scanning direction; and a cyan nozzle module 56 in which a plurality of nozzles N that eject only a cyan (C) ink are arranged linearly in the main scanning direction. The four nozzle modules 50, 52 54, and 56 are arranged integrally along the direction of printing (in the subscanning direction). A print head for monochrome printing includes only a black (K) module. A print head for high-quality images includes six or seven modules including a light-magenta (LM) nozzle module that ejects only a light magenta ink, a light-cyan (LC) nozzle module that ejects only a light cyan ink, or the like.

The print head 200 ejects ink in respective ink chambers (not shown) provided for the nozzles N1, N2 and so on from the nozzles N1, N2 and so on by piezo actuators (not shown) provided for the ink chambers, thereby printing circular dots (landing the ink) onto white print paper. The voltage to be applied to the piezo actuators is controlled in multi steps to control the amount of ink ejected from the ink chambers, allowing printing of dots of different sizes for each of the nozzles N1, N2, and so on (in this embodiment, eight patterns (sizes) including "no dot", as will be described later).

The print head 200 with such a structure sometimes cannot emit a predetermined amount of ink because of variations in the size of the holes of the nozzles N1, N2, and so on or in the feed pressure of ink.

Particularly, the variations in ink ejection tend to occur in nozzles at the end and center of the head. Specifically, nozzles at the end of the head tend to eject more than a predetermined amount of ink to print dots larger than a predetermined size; nozzles in the center of the head tend to eject less than a predetermined amount of ink to print dots smaller than a predetermined size.

For example, in the case where eight different-sized dots including "no dot" are printed, the nozzles at the end of the head form dots one to two sizes larger than those by normal nozzles; and the nozzles in the center of the head form dots one to two sizes smaller than those of the normal nozzles.

Among the properties of the print head 200, the droplet deflection phenomenon is thought to be fixed to a certain extent at the manufacture, and will relatively seldom change except by ejection failure due to ink clogging. However the ink ejection rate is thought to be changed in each nozzle by various factors such as changes in the viscosity of ink and the diameter of nozzle holes due to secular deterioration or variations in the operation of the piezo actuator.

The image-data acquiring section 20 provides the function of acquiring multilevel (M-value) color-image data to be printed, which is sent from a print indicating device (not shown), such as a personal computer (PC) or a printer server, connected to the printer 100 via a network, or reading it directly from an image (data) reader such as a scanner or a CD-ROM drive (not shown) If the multilevel color image data acquired is multilevel RGB data, e.g., image data in which the respective gradations (luminances) of colors (R, G, and B) of one pixel are expressed as 8 bits 256 levels (0 to 255), the image-data acquiring section 20 also exhibits the function of converting it to multilevel CMYK (in the case of four colors) corresponding to the inks of the print head 200.

The image-data correcting section 22 provides the function of correcting the pixel values of the multilevel image data acquired by the image-data acquiring section 20 to the characteristics of the nozzles of the print head 200. Its concrete example will be described later.

The N-level-data generating section 24 converts the multilevel image data corrected by the image-data correcting section 22 to N-level data.

Specifically speaking, the values (densities) of the pixels of the image data corrected by the image-data correcting section 22 are each specified by 8 bits, 256 levels of gray. When the data is converted to 8-level values (gray level N=8), the values of the pixels are each classified into eight groups using seven thresholds, as shown in the dot-gradation conversion table 300A of FIG. 4.

The right columns of the dot-gradation conversion table 300A of FIG. 4 show the relationship between the thresholds for the case where multilevel pixel values are converted to eight values on the assumption that gray level N=8.

Specifically, according to the dot-gradation conversion table 300A, when the value (luminance) of each pixel of multilevel image data are specified as 8 bits (0 to 255), seven thresholds, "223 (a first threshold)", "191 (a second threshold)", "159 (a third threshold)", "128 (a fourth threshold)", "96 (a fifth threshold)", "64 (a sixth threshold)" and "32 (a seventh threshold)" are used to convert the data to 8-level data: when the pixel value is 223 or more, N=1 (the luminance is 255 and the density is 0); when the pixel value ranges from 191 to 222, N=2 (the luminance is 219 and the density is 36); when the pixel value ranges from 159 to 190, N=3 (the luminance is 182 and the density 73 ); when the pixel value ranges from 128 to 158, N=4 (the luminance is 146 and the density is 109); when the pixel value ranges from 96 to 127, N=5 (the luminance is 109 and the density is 146); when the pixel value ranges from 64 to 95, N=6 (the luminance is 73 and the density is 182); when the pixel value ranges from 32 to 63, N=7 (the luminance is 36 and the density is 219); when the pixel value is 31 or less, N=8 (the luminance is 0 and the density is 255).

The print-data generating section 26 has the function of setting a dot for each pixel of the N-level data to generate print data to be used by the inkjet printing section 28.

The left columns of the dot-gradation conversion table 300A in FIG. 4 show the relationship between the pixel values of the N-level data and dot sizes used by the print-data generating section 26.

In the example of the table, when the data is converted to 8-level data from "gray level N=8", and "luminance " is selected as pixel value, the dot number is 0 for the case of N=1 and its dot size is "no dot"; the dot number is 1 for the case of N=2 and its dot size is the smallest; and the dot number is 2 for the case of N=3 and its dot size is the second largest in area. The dot number is 3 for the case of N=4 and its dot size is the third largest: the dot number is 4 for the case of N=5 and its dot size is the fourth largest. The dot number is 5 for the case of N=6 and its dot size is the fifth largest; the dot number is 6 for the case of N=7 and its dot size is the sixth largest; and the dot number is 7 for the case of N=8 and its dot size is the largest. When "luminance" is adopted as the pixel value, the data is converted to dots opposite to the "density" in relation.

The printing section 28 ejects ink from the nozzle modules 50, 52, 54, and 56 of the print head 200 while moving one or both of a print medium (paper) and the print head 200 in dot shape to form a predetermined image made up of multiple dots on the print medium. In addition to the print head 200, the image-data acquiring section 20 includes known components, such as a print-head moving mechanism (for a multipass type, not shown) that reciprocates the print head 200 across the width of a print medium, a paper feeding mechanism (not shown) for moving the print medium, and a print controller mechanism (not shown) that controls the ink ejection of the print head 200 on the basis of the print data.

The test-pattern forming section 10 forms a test pattern to be used in investigating the characteristics of the nozzles N of the print head 200.

For example, when the nozzles N can print eight dot patterns including "no dot", as described above, the test-pattern forming section 10 forms original images corresponding to densities obtained only with the dot patterns, and converts the original images to N-level data, thereby forming eight kinds of test patterns by density.

Figure 5:
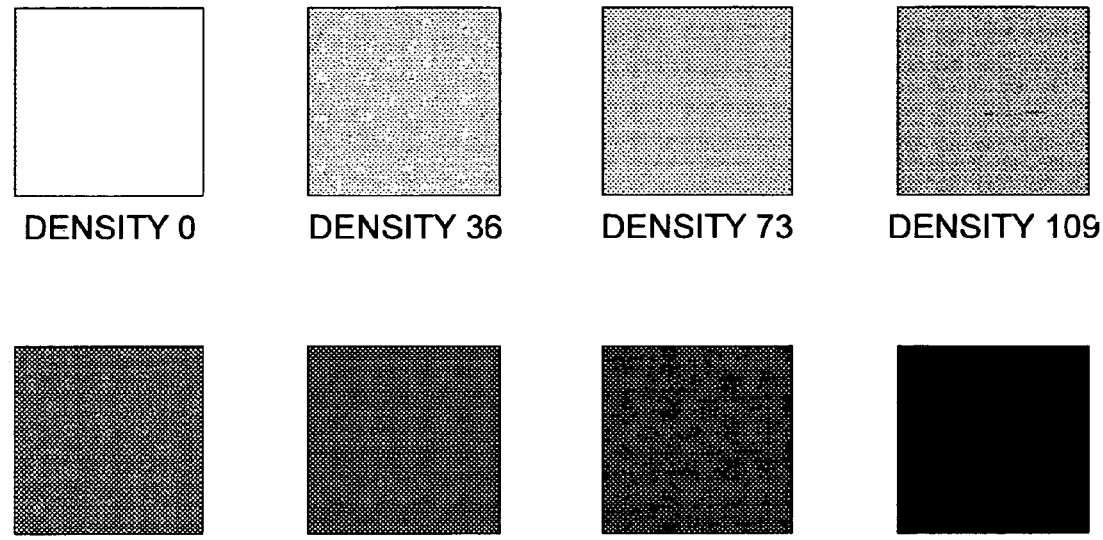
FIG. 5 is a schematic diagram of the original images of test patterns.
Figure 6:
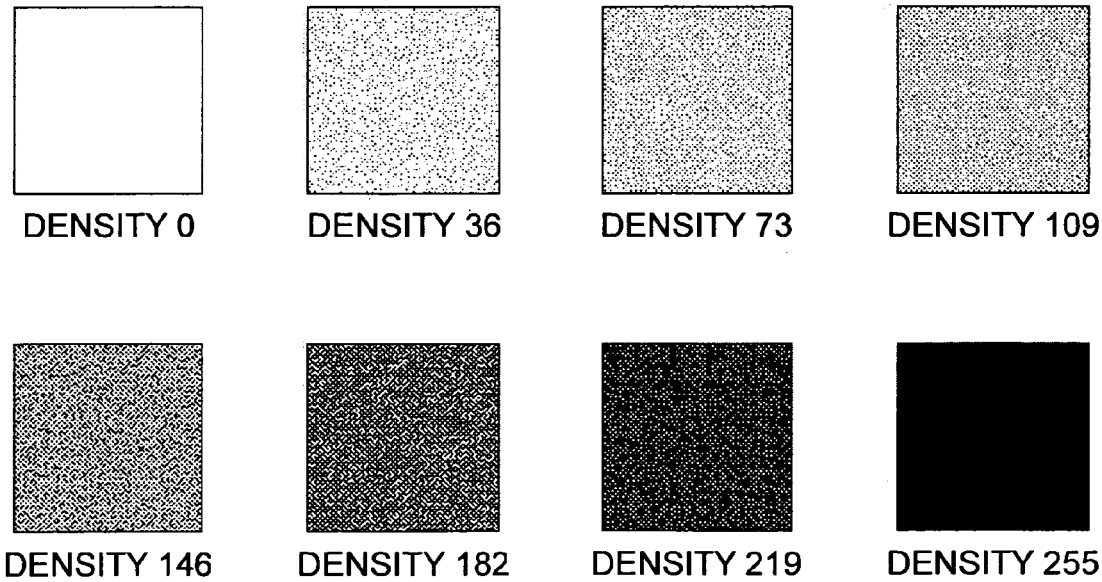
FIG. 6 is a schematic diagram of N-level test patterns.

FIG. 5 shows original images corresponding to eight densities, "0", "36", "73", "109", "146", "182", "219", "255", of 256 patterns of densities expressed as eight densities (8 bits, 256 levels (0 to 255) which are the originals of the test patterns. FIG. 6 shows N-level images that are converted from the eight original images on the basis of the dot-gradation conversion table 300A shown in FIG. 4. When the print head 200 has four-color ink modules, as described above, it forms 32 (8×4=32) kinds of test patterns that are eight kinds of N-level images for each color.

When the test patterns formed by the test-pattern forming section 10 is stored in a test-pattern storage section 10a formed of a hard disk, then it may be read from the test-pattern storage section 10*a* and used as the need arises.

The test-pattern printer 12 provides the function of printing the test patterns formed by the test-pattern forming section 10 using the nozzles of the print head 200.

Figure 7:
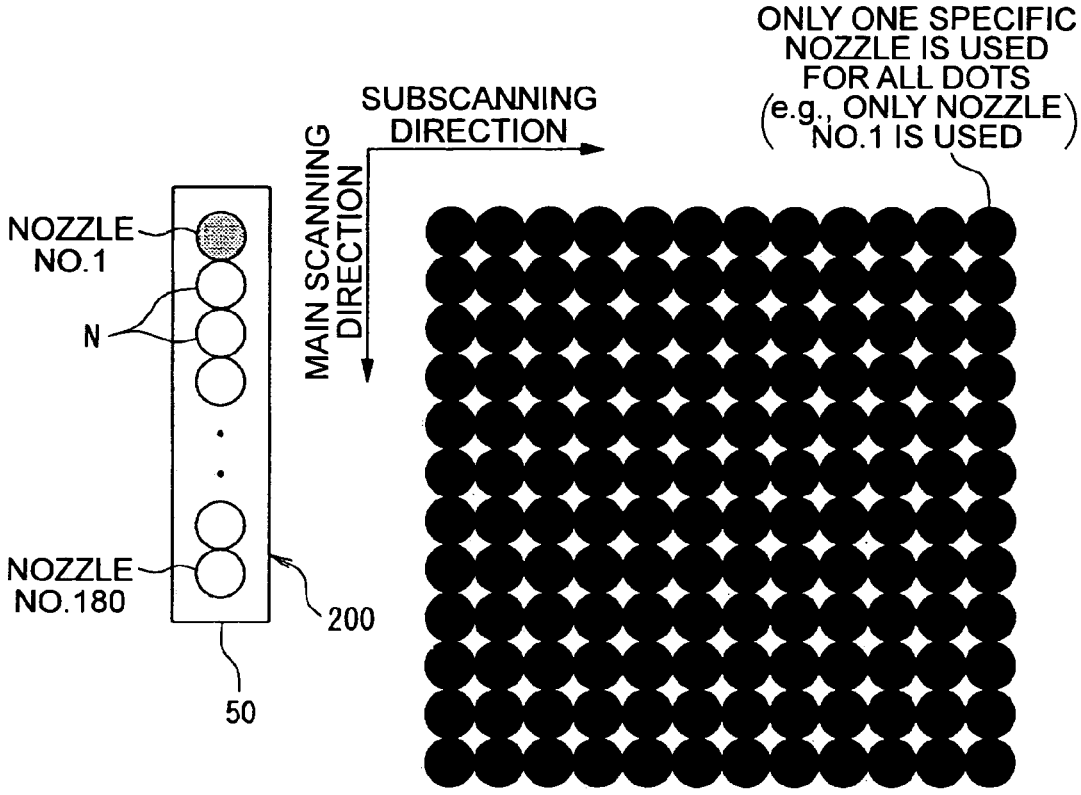
FIG. 7 is an enlarged conceptual diagram of an example of a dot pattern in which dots of a size are printed in a unit area with a single nozzle.

FIG. 7 shows a rectangular dot pattern with a specified area formed by moving the print head 200 vertically and laterally (in the main scanning direction and in the subscanning direction) to print dots of a size with only a nozzle N1 of nozzle NO. 1 of the ink module 50 of the print head 200.

Figure 8:
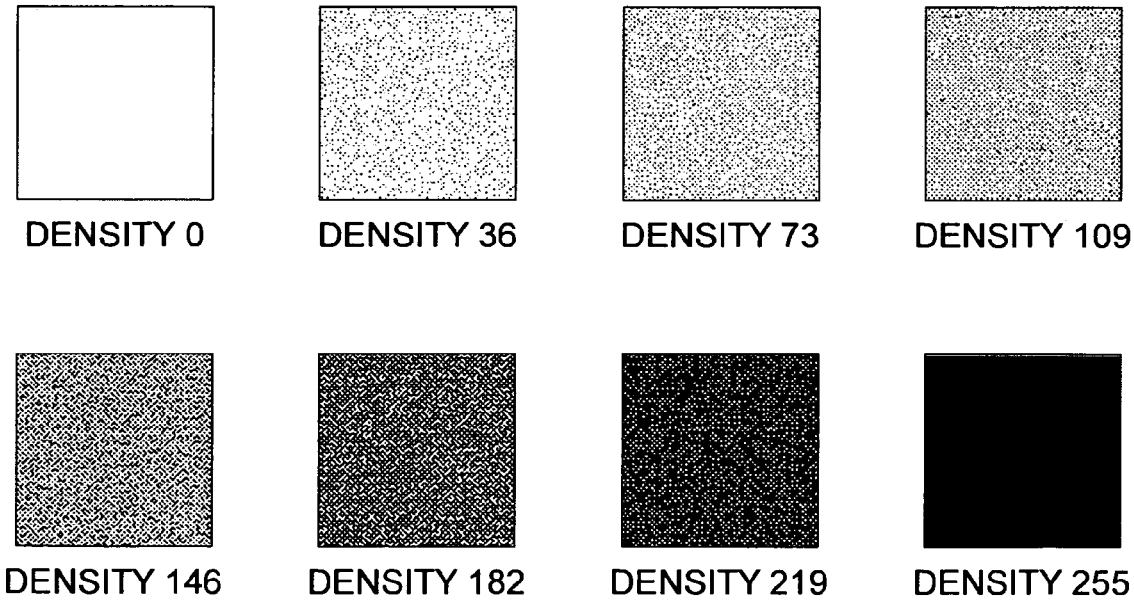
FIG. 8 is a diagram showing examples of test patterns that are actually printed with a single nozzle.

More specifically, when the number of the nozzles N of the ink module 50 of the print head 200 is 180, as shown in FIG. 7, the test-pattern printer 12 performs such an operation as printing eight kinds of test patterns, shown in FIG. 8, using only the nozzle N1 of nozzle No. 1, and then printing eight kinds of test patterns using only a nozzle N2 of nozzle No. 2, for all the 180 nozzles N, thereby printing test patterns with different densities for each nozzle.

As a result, as shown in FIG. 3, with the print head 200 including the four ink modules 50, 52, 54, and 56 each having 180 nozzles, "180 (the number of nozzles of one module)×8 (the number of printable dot patterns)×4 (the number of ink modules)=5760" test patterns can be printed at the maximum.

The output-density detector 14 optically reads the densities of the test patterns printed by the test-pattern printer 12 to determine the actual output densities of the test patterns, as with known scanners.

More specifically, the output-density detector 14 specifies a predetermined region for each gradation of the test patterns, detects the density in the specified regions with a CCD unit having multiple image-pickup devices, and determines the mean of the densities obtained by the image-pickup devices as the density of each gradation.

General scanners cannot detect an accurate value for portions with significant unevenness in density (luminance) because of their optical characteristics. It is therefore necessary to select a narrow region except the rims of the gray-level regions and detect the density.

The input-and-output-density information generator 16 outputs information indicative of the relationship between the actual output densities thus detected and the original input densities of the test patterns as an input-and-output-density-characteristic information table, and calculates a density for which the relationship between the input density and the output density is not shown in the table by drawing an approximate curve from the relationship between the input density and the output density.

Figures 9, 10:
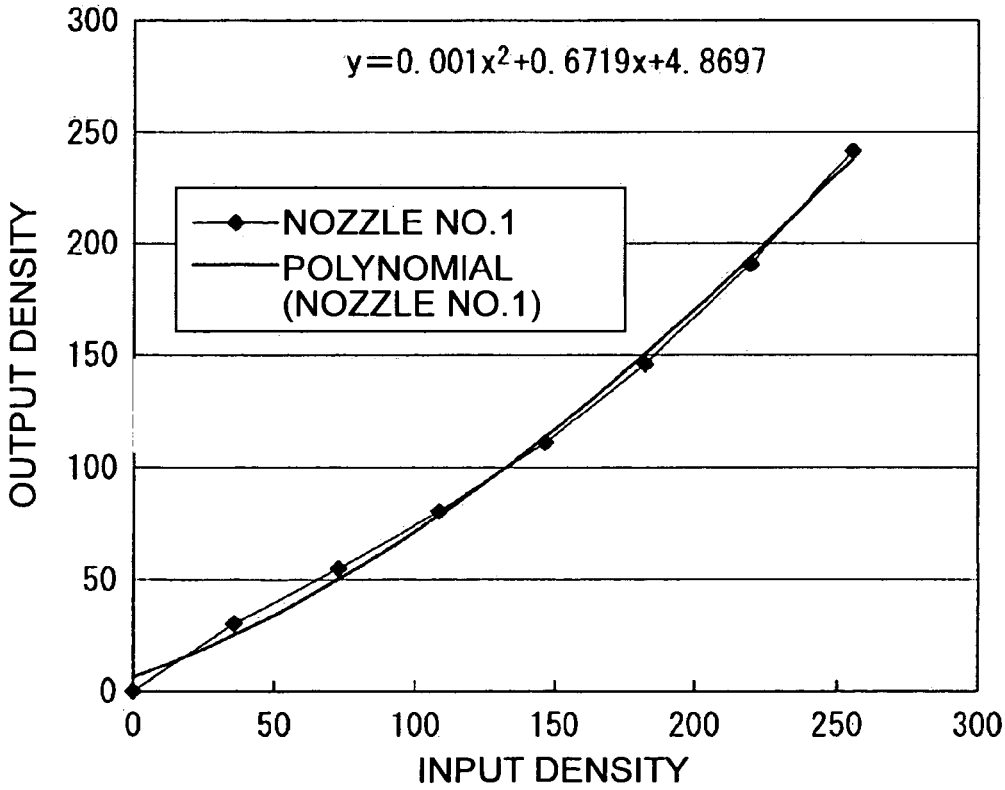
FIG. 9 is a diagram showing an example of an input-density-and-output-density-characteristic information table.
FIG. 10 is a graph showing the relationship between input densities and output densities.

FIG. 9 shows an example of an input-density-and-output-density-characteristic information table 300B produced by the input-and-output density information generator 16.

For example, for the nozzle of nozzle No. 1, the output density (mean value) of the test pattern with an input density "36" is 30, indicating that the output density has a deviation of "−6" from the input density "36"; and the output density of the test pattern with an input density "73"is "55", indicating that the output density has a deviation of "−18" from the input density "73". Similarly, for the nozzle of nozzle No. 2, the output density (mean value) of the test pattern with an input density "36" is "26", indicating that the output density has a deviation of "−10" from the input density "36"; and the output density of the test pattern with an input density "73" is "63", indicating that the output density has a deviation of "−10" from the input density "73".

When the relationship between the discrete input densities and output densities is plotted on a graph, and quadratic functions (approximate curve) between the plotted points are obtained, then the relationship between densities that are not shown in the input-density-and-output-density-characteristic information table 300B can be determined from the quadratic functions.

FIG. 10 shows a quadratic curve ($y=0.001x^2+0.6719x+4.8697$) indicative of the relationship between the input densities and the output densities of the nozzle of nozzle No. 1.

For example, the use of the graph of FIG. 10 facilitates finding an output density of "approximate 70" for an input density of "100" that is not shown in the input-density-and-output-density-characteristic information table 300B.

The input-density correcting section 18 creates an input-density correction table (γ correction table) 300C for correcting input densities from the input-density-and-output-density-characteristic information table 300B so that the output densities that are the results of actual printing by the nozzles become equal to the input densities.

Figures 11, 12:
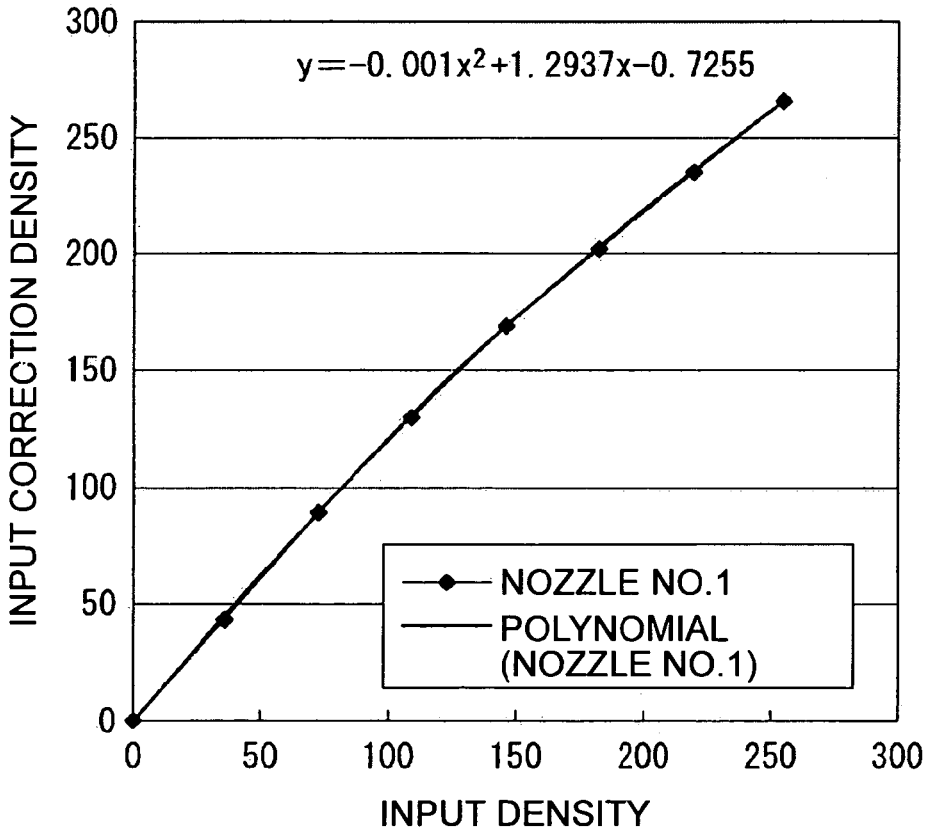
FIG. 11 is a diagram showing an example of an input-density correction table.
FIG. 12 is a graph showing the relationship between input densities and corrected input densities.

FIG. 11 shows an example of the input-density correction table (γ correction table) 300C that indicates the relationship between the input densities and input-density correction values for each nozzle.

For example, for the nozzle of nozzle No. 1, the corrected density for an input density "36" is "43", indicating that the output density has a deviation of "+7" from the input density "36"; and the corrected density for an input density "73" is "89", indicating that the output density has a deviation of "+16" from the input density "73". For the nozzle of nozzle No. 2, the corrected density for an input density "36" is "44", indicating that the output density has a deviation of "+8" from the input density "36"; and the corrected density for an input density "73" is "87", indicating that the output density has a deviation of "+14" from the input density "73".

When the discrete data is plotted on a graph, and quadratic functions (approximate curve) between the plotted points are obtained, the relationship between input densities and corrected densities that are not shown in the input-density correction table 300C can be found.

FIG. 12 shows a quadratic curve ($y=0.001x^2+1.2937x-0.7255$) indicative of the relationship between the input densities and the corrected input densities of the nozzle of nozzle No. 1. For example, the use of the graph of FIG. 12 facilitates finding a corrected density of "approximate 120" for an input density of "100" that is not shown in the input-density correction table 300C.

The image-data correcting section 22 corrects the densities of the multilevel image data acquired by the image-data acquiring section 20 according to the corrected input densities for each nozzle obtained by the input-density correcting section 18. Which nozzle corresponds to which pixel (value) can be calculated from the address of each pixel in the image data and the address of each nozzle of the print head 200.

Figure 2:
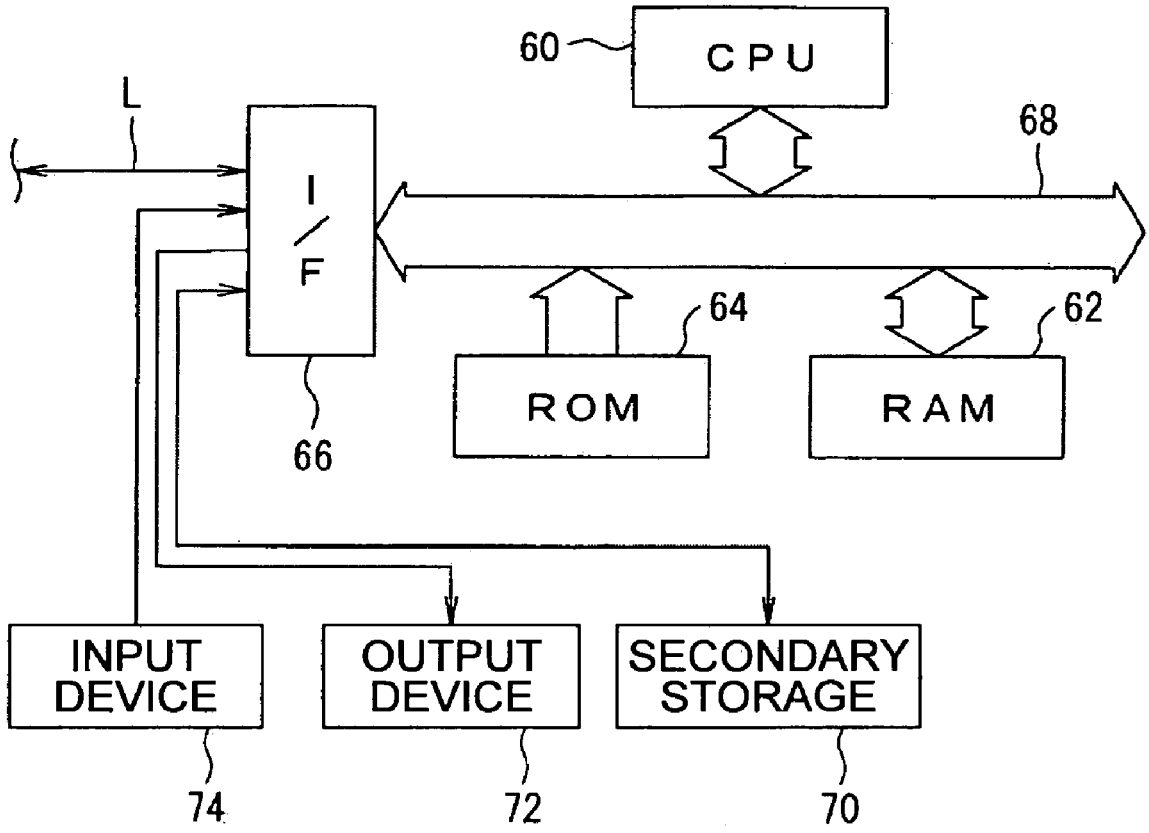
FIG. 2 is a block diagram of the hardware configuration of a computer system for implementing the printer according to the invention.

The printer 100 includes a computer system for implementing the test-pattern forming section 10, the test-pattern printer 12, the output-density detector 14, the input-and-output-density-information generator 16, the input density correcting section 18, the image-data acquiring section 20, the image-data correcting section 22, the N-level-data generating section 24, the print-data generating section 26, and the printing section 28 via software. As shown in FIG. 2, the hardware is configured as follows: a central processing unit (CPU) 60 for various controls and operations, a random access memory (RAM) 62 serving as a main storage, and a read only memory (ROM) 64 are connected via various internal and external buses 68 such as a peripheral component interconnect (PCI) bus and an industrial standard architecture (ISA) bus. The buses 68 connect to a secondary storage: 70 such as a hard-disk drive (HDD); output devices 72 such as the printing section 28, a CRT monitor, and a LCD monitor; input devices 74 such as an operation panel, a mouse, a keyboard, and a scanner; and a network L for communicating with a print indicating device (not shown) via an input and output interface (I/F) 66.

When power is applied, a system program stored in the ROM 64 or the like, such as a BIOS, loads various dedicated computer programs stored in the ROM 64 or various dedicated computer programs installed in the secondary storage 70 via the network L such as the Internet or a storage medium such as a CD-ROM, a DVD-ROM, or a flexible disk (FD) into the RAM 62. Then the CPU 60 executes predetermined controls and operations using various resources according to the instructions described in the programs loaded in the RAM 62. Thus the functions of the foregoing devices can be achieved via software.

Referring to the flowcharts of FIGS. 13 to 15, an example of the flow of the printing process using the printer 100 with this structure will be described.

Figure 13:
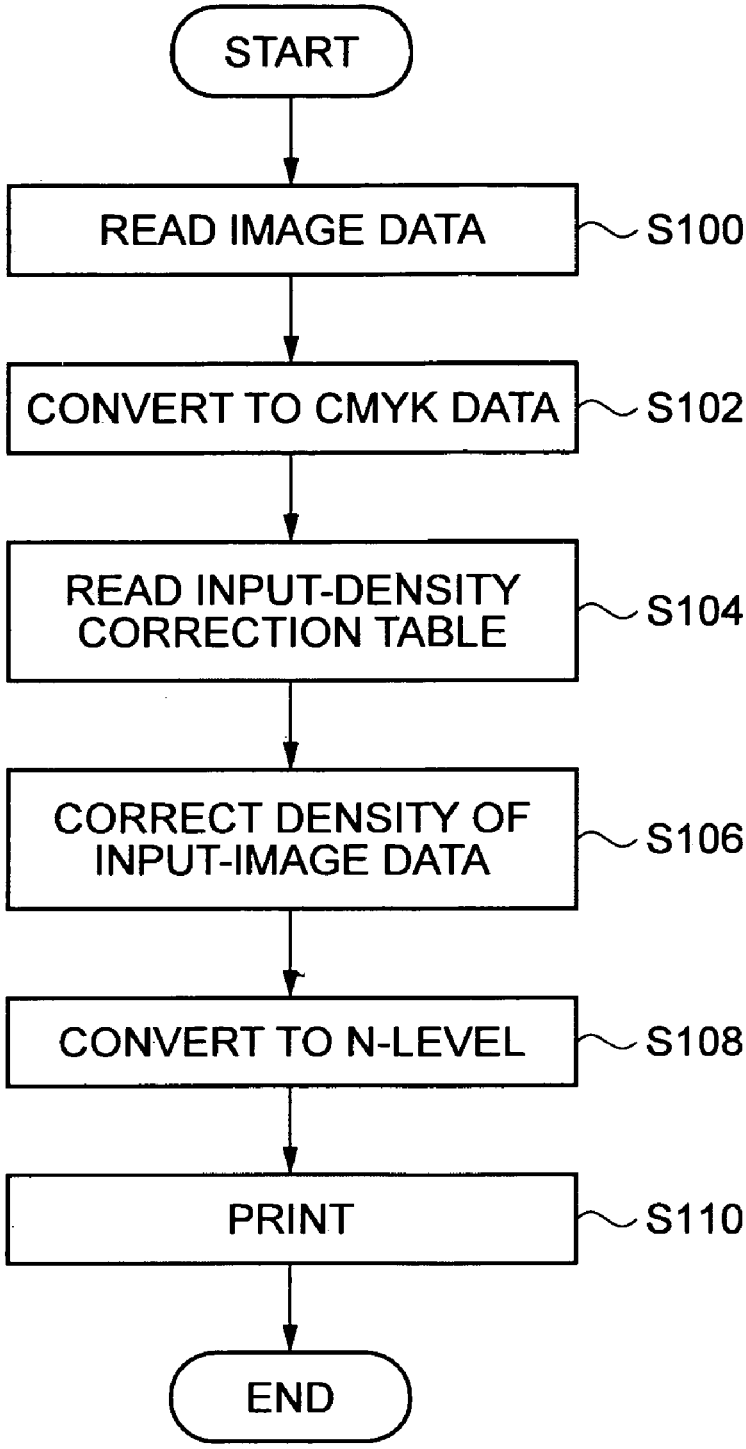
FIG. 13 is a flowchart for the overall process of the printer according to the embodiment of the invention.

FIG. 13 shows the flow of the whole printing process by the printer 100 according to an embodiment of the invention.

As shown in the drawing, upon completion of a specified initial operation for printing after power is applied, the printer 100 monitors a print instruction terminal such as a computer (not shown), if connected, to determine whether an explicit print instruction is given from the print instruction terminal, wherein when the print instruction and multilevel image data to be processed are sent, the procedure moves to the first step S100, wherein the image data is read (acquired), and proceeds to the next step S102. When the image data is RGB-color image data, the printer 100 converts the color image data to CMYK color image corresponding to the colors of inks of the print head 200.

The procedure then proceeds to S104, wherein the input-density correction table 300C prepared for the print head 200, shown in FIG. 11, and the procedure moves to step S106. In step S106, the density of the input image data is corrected on the basis of the input-density correction table 300C. The procedure then proceeds to step S108, wherein the corrected image data is converted to N-level data to form print data, and finally, printing is executed in step S110.

Figure 14:
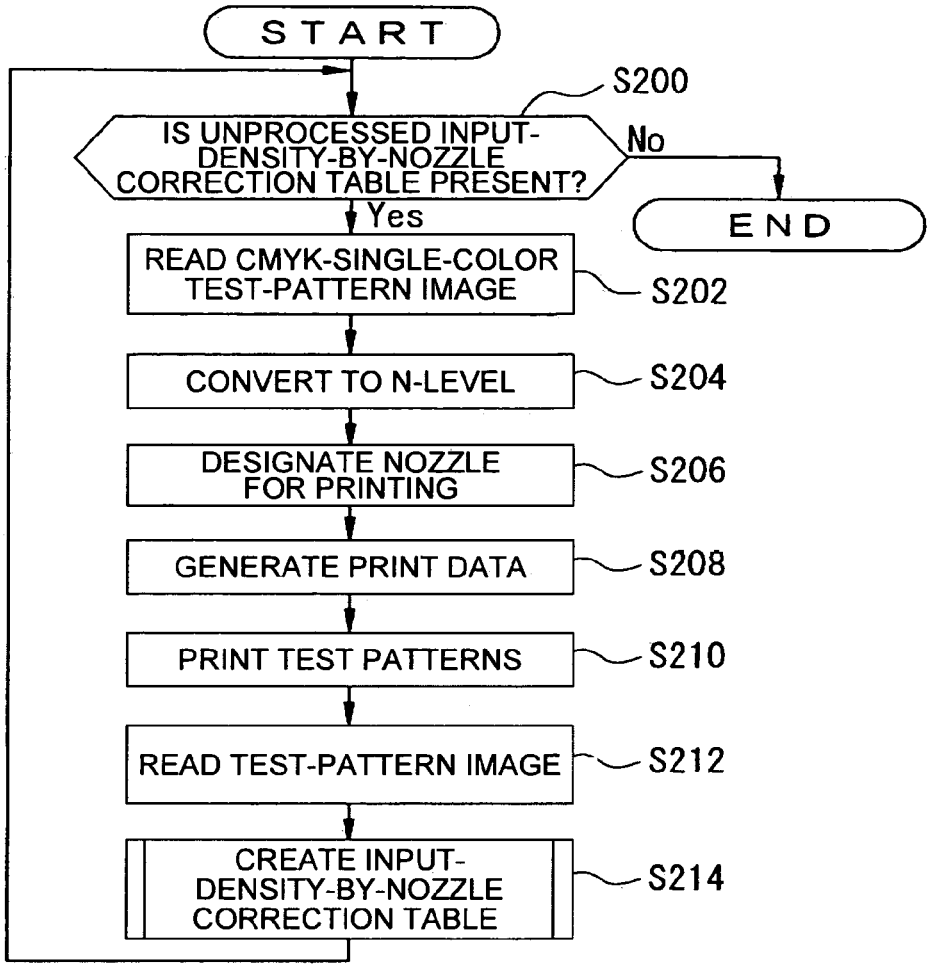
FIG. 14 is a flowchart for the process of creating an input-density correction table.

FIG. 14 shows an example of the flow of the process of creating the input-density correction table 300C for use in step S104.

In the first step S200, it is determined whether an input-density correction table 300C for unprocessed nozzles is present, wherein when it is determined that there is no unprocessed-nozzle input-density correction table 300C (No), the procedure is terminated; when it is determined that the unprocessed-nozzle input-density correction table 300C is present (Yes), the procedure proceeds to the next step S202, wherein single-color test-pattern images of CMYK for the processed nozzles are read. The procedure then moves to step S204, wherein the test-pattern images are converted to N-level images. Then, in step S206, target unprocessed nozzles for printing are designated.

The procedure then proceeds to step S208, wherein print data is generated from the N-level test-pattern images, and in the next step S210, test patterns are printed from the print data using the nozzles.

In step S212, the test patterns are read, and the actual output densities are determined. In the next step S214, the relationship between the input densities and the actual output densities is found. Thus, the input-density correction table 300C by nozzle can be created.

Figure 15:
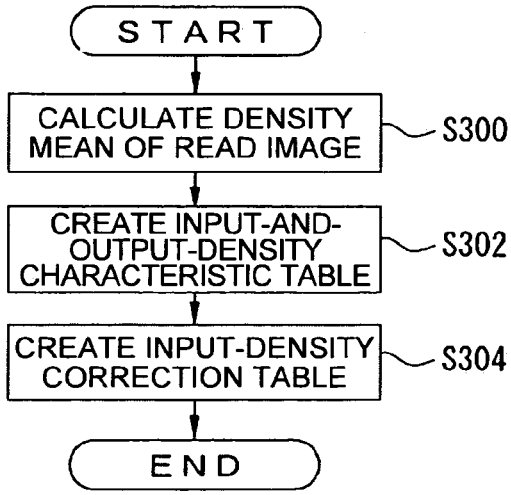
FIG. 15 is a flowchart for the process of creating the input-density correction table.

FIG. 15 shows an example of the creation of the input-density correction table 300C by nozzle in step S214. In the first step S300, the mean of the densities of read images is calculated from the results of reading of the test patterns to form the, input-density-and-output-density-characteristic information table 300B, shown in FIG. 9. Then the procedure moves to step S304, wherein the input-density correction table 300C is created.

Thus, according to an embodiment of the invention, input-density corrected value is determined for each nozzle of the print head 200 from its actual output densities, and then the densities of image data are corrected using the input-density corrected values. This eliminates unevenness in density to prevent the degradation in print quality due to a banding phenomenon.

Since the density of the original image data can be reproduced with high fidelity, high-quality color print such as photographs can be ensured.

The print head 200 according to the embodiment corresponds to the print head of the printer in Form 1 of Summary. The test-pattern forming section 10, the test-pattern printer 12, the output-density detector 14, the input-and-output-density-information generator 16, the input density correcting section 18, and the printing section 28 correspond to the test-pattern forming section, the test-pattern printing section, the output-density detecting section, the input- and output-density-information generating section, the input-density correcting section, and the printing section of the printer in Form 1 of Summary, respectively.

The dots ejected by the print head 200 according to an embodiment of the invention and the general print head 200 have eight patterns in size including "no dot as shown in FIG. 4. The kinds of the dot size are not limited to that, but may be at least two patterns in addition to "no dot", and it is preferable that there be many patterns.

According to an embodiment of the invention, the input density of acquired image data is corrected according to the output density of each nozzle without alternation to the existing print head 200 and printing section 28. Accordingly, there is no need to prepare dedicated devices as the print head 200 and the printing section 28, but the existing inkjet print head 200 and printing section 28 (printer) can be put to practical use.

Accordingly, when the print head 200 or the printing section 28 is separated from the printer 100 of the invention, its function can be achieved only in general information processors (image processing units) such as personal computers.

It is to be understood that the printer 100 is not limited to the form in which all the functions are accommodated in one casing, but may have a structure in which the functions are divided in such a manner that part of the functions, e.g., functions from the test-pattern forming section 10 to the input-density correcting section 18 are implemented by the personal computer, and functions from the image-data acquiring section 20 to the printing section 28 are implemented by the printer.

The printer 100 according to an embodiment of the invention can be applied not only to a line-head inkjet printer but also to a multipass inkjet printer.

Figure 16A:
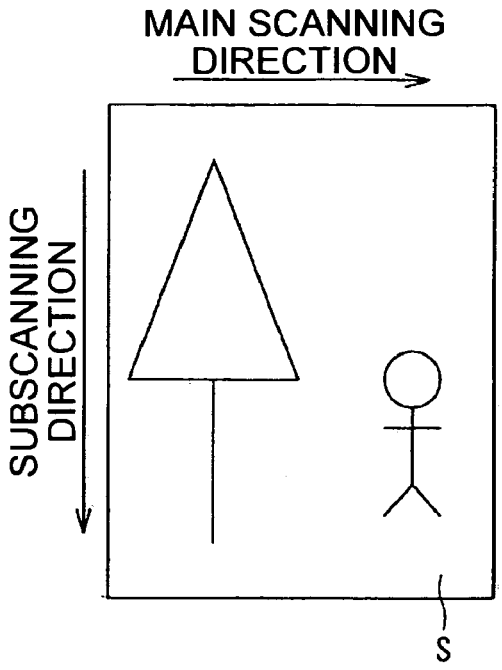
FIG. 16A is a diagram showing the main scanning direction and the subscanning direction of print paper.
Figure 16B:
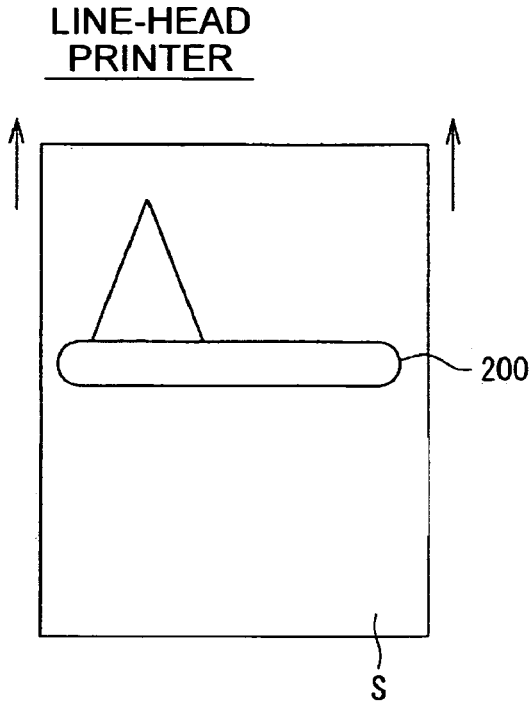
FIG. 16B is an explanatory diagram of a multipass inkjet printer.
Figure 16C:
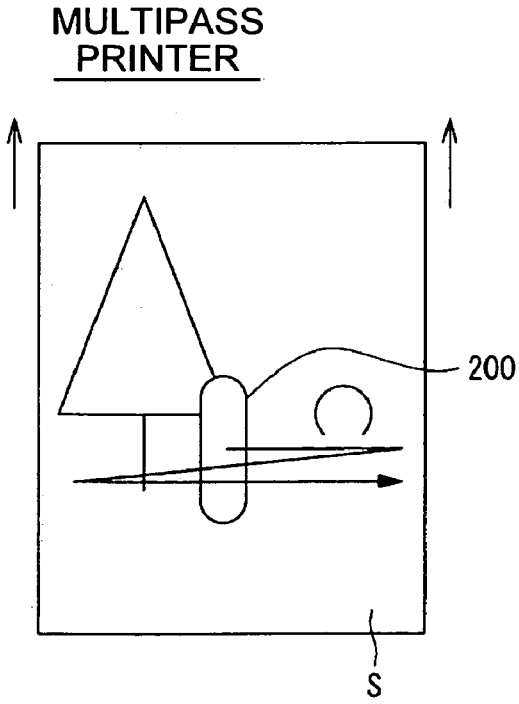
FIG. 16C is an explanatory diagram of a line-head inkjet printer.

FIG. 16B shows the print system of a line-head inkjet printer; and FIG. 16C shows the print system of a multipass inkjet printer.

As shown in FIG. 16A, assuming that the width direction of rectangular print paper S is the main scanning direction of image data, and the longitudinal direction is the subscanning direction of the image data, the print head 200 has a length corresponding to the width of the print paper S, as shown in FIG. 16B. Printing can be completed in so-called one pass (operation) by fixing the print head 200 and moving the print paper S in the subscanning direction relative to the printhead 200. Printing can be performed by fixing the print paper S and moving the print head 200 in the subscanning direction, as with what-is-called flat-bed scanners, or alternatively, by moving both of them in opposite direction. In contrast, as shown in FIG. 16C, the multipass inkjet printer executes printing by locating the print head 200 that is far shorter than the width of the paper in the direction orthogonal to the main scanning direction, and moving the print paper S in the subscanning direction at a specified pitch while reciprocating the print head 200 in the main scanning direction. Accordingly, the latter multipass inkjet printer has the disadvantage of taking more printing time than the former line-head inkjet printer; but on the other hand, it can significantly reduce the input-density correcting process because of a significant decrease in the number of nozzles to be corrected.

Although this embodiment has been described using the inkjet printer that performs printing by ejecting ink in dot shape by way of example, the invention can also be applied to other printers that use a print head in which print mechanisms are arranged linearly, e.g., thermal head printers called thermal-transfer printers or thermal printers.

Figure 17:
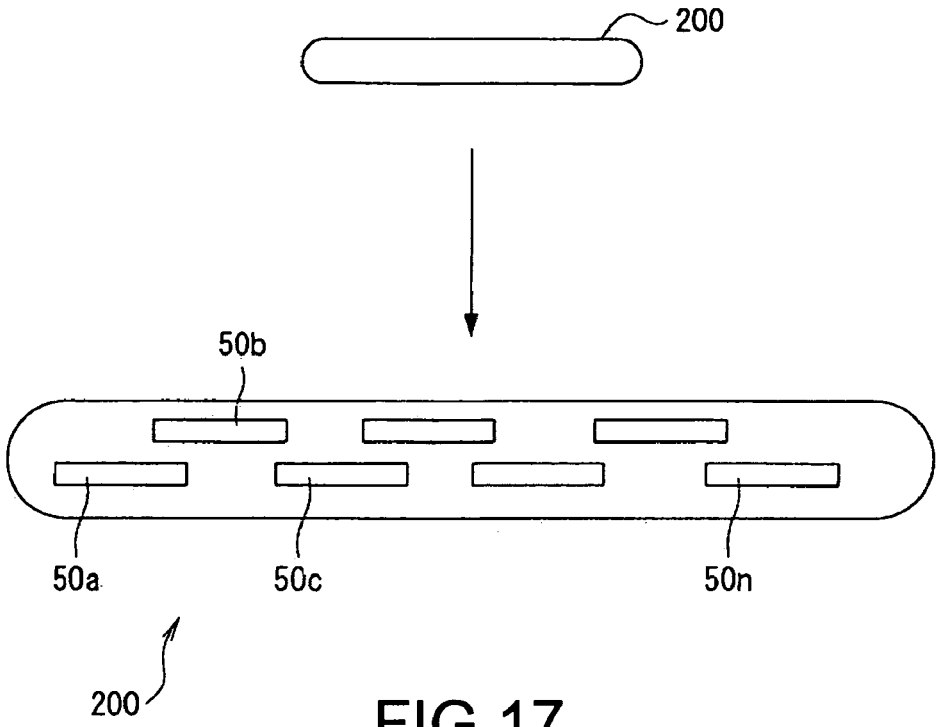
FIG. 17 is a conceptual diagram of another example of the structure of the print head.

Referring back to FIG. 3, the nozzle modules 50, 52, 54, and 56 of the print head 200 for each color have the nozzles N along the length of the print head 200 in a straight line. Alternatively, as shown in FIG. 17, each of the nozzle modules 50, 52, 54, and 56 may be made up of short nozzle units 50*a*, 50*b* to 50*n*, and may be disposed along the moving direction of the print head 200. The structure in which the nozzle modules 50, 52, 54, and 56 are each made up of short nozzle units 50*a*, 50*b* to 50*n* improves the yield as compared with long nozzle units.

Figure 18:
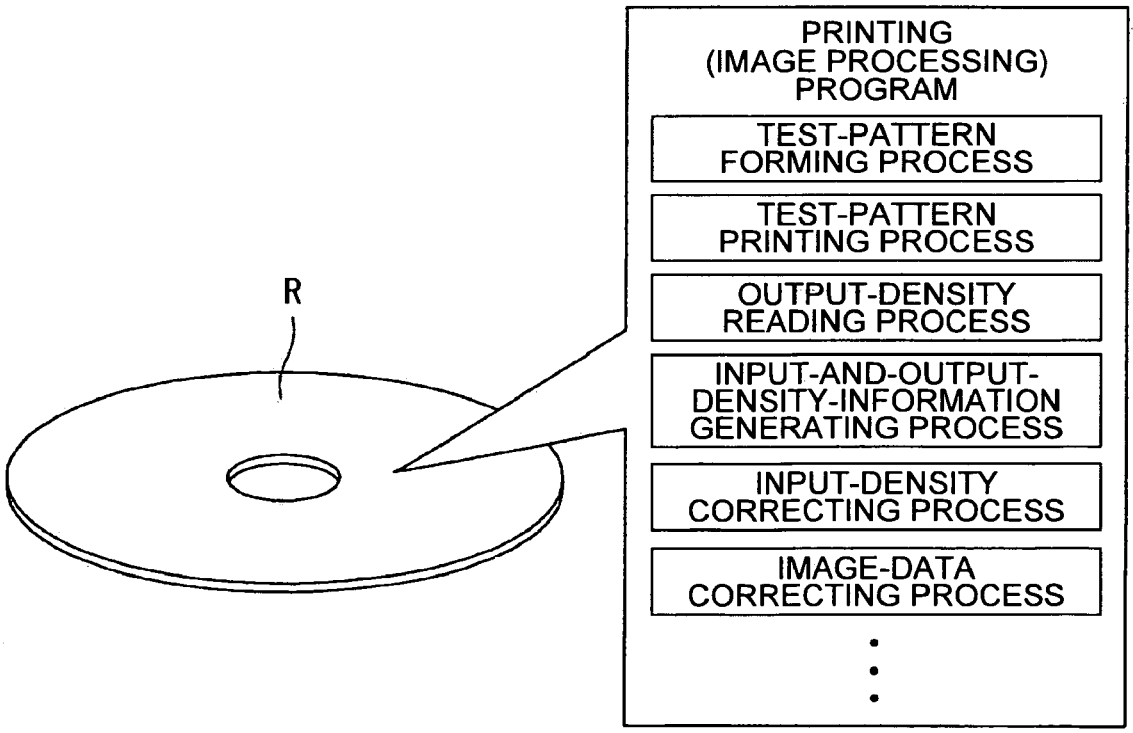
FIG. 18 is a conceptual diagram of an example of a computer-readable recording medium in which a program according to an embodiment of the invention is recorded.

The foregoing sections of the printer 100 of the invention can be implemented via software that uses a computer system installed in most existing printers. The computer program can easily be provided for users who want to have it by assembling it in products in a state in which it is stored in a semiconductor ROM, or via a network such as the Internet of a computer-readable recoding medium R such as CD-ROMs, DVD-ROMs, or FDs as shown in FIG. 18.

What is claimed is:

1. A printer comprising:

a print head including a plurality of nozzles capable of printing dots of different sizes;

a test-pattern forming section that forms test patterns each having only one dot size;

a test-pattern printing section that prints the test patterns formed by the test-pattern forming section for each nozzle of the print head;

an output-density reading section that optically reads the test patterns printed by the test-pattern printing section to determine the output densities of the test patterns;

an input-and-output-density-characteristic-information generating section that generates input-and-output density information indicative of the relationship between the output densities read by the output-density reading section and the input densities of each test pattern formed by the test-pattern forming section;

an input-density correcting section that corrects the input density of each nozzle of the print head on the basis of the input-and-output density information generated by the input-and-output-density-characteristic-information generating section; and a printing section that executes printing using the input densities corrected for each nozzle by the input-density correcting section.

2. The printer according to claim 1, wherein the test-pattern printing section prints the test patterns formed by the test-pattern forming section for each nozzle using one of the nozzles of the print head.

3. The printer according to claim 1, wherein the test-pattern printing section prints the test patterns formed by the test-pattern forming section for the series of multiple nozzles of the print head using all of the nozzles collectively.

4. The printer according to claim 1, wherein the test patterns printed by the test-pattern printing section are formed of dots of a specified size printed continuously lengthwise and breadthwise in a unit area on a printing medium; and the output-density reading section reads only the region of each test pattern except the boundary with the printing medium.

5. The printer according to claim 1, wherein the input and output-density-characteristic information generating section generates an approximate curve indicative of the relationship between the input densities and the output densities in the input-and-output density information to calculate intermediate output densities corresponding to the intermediate input densities between the dots from the approximate curve; and the input-density correcting section corrects the intermediate input densities between the dots according to the intermediate input densities between the dots calculated by the input-and-output-density-information generating section.

6. The printer according to claim 1, wherein the input-and-output-density-information generating section creates a lookup table indicative of the relationship between the input densities and the output densities in the input-and-output density information, and calculates intermediate output densities corresponding to the intermediate input densities between the dots from the lookup table; and the input-density correcting section corrects the intermediate input densities between the dots according to the intermediate input densities between the dots calculated by the input-and-output-density-information generating section.

7. A print program for a computer to implement:

a test-pattern forming section that forms test patterns each have only one dot size for each of the different dot sizes of a print head including a plurality of nozzles capable of printing dots of different sizes;

a test-pattern printing section that prints the test patterns formed by the test-pattern forming section for each nozzle of the print head;

an output-density reading section that optically reads the test patterns printed by the test-pattern printing section to determine the output densities of the test patterns;

an input-and-output-density-characteristic-information generating section that generates input-and-output density information indicative of the relationship between the output densities read by the output-density reading section and the input densities of each test pattern formed by the test-pattern forming section;

an input-density correcting section that corrects the input density of each nozzle of the print head on the basis of the input-and-output density information generated by the input-and-output-density-characteristic-information generating section; and a printing section that executes printing using the input densities corrected for each nozzle by the input-density correcting section.

8. A computer-readable recording medium in which the print program according to claim 7 is recorded.

9. A printing method comprising:

forming test patterns each have only one dot size for each of the different dot sizes of a print head including a plurality of nozzles capable of printing dots of different sizes;

printing the test patterns formed in the test-pattern forming step for each nozzle of the print head;

optically reading the test patterns printed in the test-pattern printing step to determine the output densities of the test patterns;

generating input-and-output density information indicative of the relationship between the output densities read in the output-density reading step and the input densities of each test pattern formed by the test-pattern forming section;

correcting the input density of each nozzle of the print head on the basis of the input-and-output density information generated in the input-and-output-density-characteristic information generating step; and executing printing using the input densities corrected for each nozzle in the input-density correcting step.

* * * * *